US006868912B2

(12) United States Patent
Proctor

(10) Patent No.: US 6,868,912 B2
(45) Date of Patent: Mar. 22, 2005

(54) TENSION THRUST ESPCP SYSTEM

(75) Inventor: Bruce Erwin Proctor, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 51 days.

(21) Appl. No.: 10/369,149

(22) Filed: Feb. 19, 2003

(65) Prior Publication Data

US 2004/0159442 A1 Aug. 19, 2004

(51) Int. Cl.[7] ..... E21B 43/00
(52) U.S. Cl. ..... 166/378; 166/105; 403/359.5
(58) Field of Search ..... 166/378, 105, 166/68; 417/365; 464/18, 19, 179, 182, 112, 905; 403/359.5, 305, 306, 379.3, 378, 109.6; 279/16

(56) References Cited

U.S. PATENT DOCUMENTS 2,829,503 A * 4/1958 Hayes ..... 173/128
2,924,180 A * 2/1960 Bourke et al. ..... 418/48
3,600,113 A * 8/1971 Pahl et al. ..... 418/48
4,960,009 A * 10/1990 Schultz et al. ..... 74/473.29
5,411,383 A * 5/1995 Parnell et al. ..... 418/48
5,501,580 A 3/1996 Barrus et al.
5,562,360 A * 10/1996 Huang ..... 403/379.1
5,591,580 A 1/1997 Bergmeyer et al.
5,896,820 A * 4/1999 Klinkner et al. ..... 111/191
6,193,474 B1 * 2/2001 Tetzlaff ..... 417/360

OTHER PUBLICATIONS

U.S. Appl. No. 10/160,899, filed Dec. 5, 2002, Mack et al.

* cited by examiner

*Primary Examiner*—Kenn Thompson
(74) *Attorney, Agent, or Firm*—Bracewell & Patterson, L.L.P.

(57) ABSTRACT

A submersible pump assembly has a pump section, a seal section and a motor section. Within each section are shafts. The adjacent shaft sections are matingly engaged with one another, and are connected by fasteners. The fasteners consist of a key and a screw that fits within the key. The fasteners secure the adjacent shaft sections to one another to transmit torque from one shaft to the other, and to transmit thrust in axial tension from one shaft to the other.

12 Claims, 3 Drawing Sheets

TENSION THRUST ESPCP SYSTEM

BACKGROUND OF THE INVENTION

1. Field of the Invention

This invention relates in general to submersible well pumps, and in particular to devices for connecting and fastening shaft elements and other portions of submersible pump assemblies.

2. Description of Prior Art

Electrical submersible pump ("ESP") assemblies for pumping fluid from deep wells are typically made up of a series of interconnectable modular components including a motor, a seal section, and one or more pump sections with an associated fluid intake. One type of pump is a centrifugal pump made up of a large number of impellers and diffusers. Another type is a progressive cavity pump, which comprises a helical rotor rotated within an elastomeric stator having helical cavities. Each of the sections of these pumps includes an outer radial housing and interior shaft elements. The shaft elements of the different adjacent sections are connected to one another in coupling assemblies by some connection means. An example of connection means would be a set of matingly engaged splines.

During conventional ESP operation, the motor section drives the various shaft elements as well fluid is discharged to the ground surface. The shaft elements may be in clockwise rotation and the direction of thrust is downward, thus creating a compression load that is transmitted between the shaft elements. As a result of this compression, the splined connections between the shaft elements are forced together, keeping the connections intact. Thrust bearings in the seal section contain the downward thrust.

However, in situations where an ESP is operated in reverse rotation, the direction of thrust within the pump assembly is upward. In this situation, the shaft elements tend to move upward as well, creating a tension load. In a progressing cavity pump, particularly, this can cause the splined connections between the shaft elements to separate and become disengaged. Installing a physical stop element at the pump discharge can prevent this disengagement. However, stops present a significant drawback, as the placement of the stop must be matched in each individual ESP system, the weld integrity is critical, the skills involved in welding the stop must be duplicated at satellite locations, and the amount of upthrust is limited.

SUMMARY OF INVENTION

The invention provides a fastener for securing connected shaft elements within an electrical submersible pump assembly so that they do not become disengaged. The secured shaft elements can be from a seal section and a motor section, a motor section and a pump section, a pump section and a seal section, and so forth. The shaft sections are secured so as to support tension loading during reverse rotation as well as compression loading during clockwise rotation.

BEST MODE FOR CARRYING OUT THE INVENTION

Figure 1A:
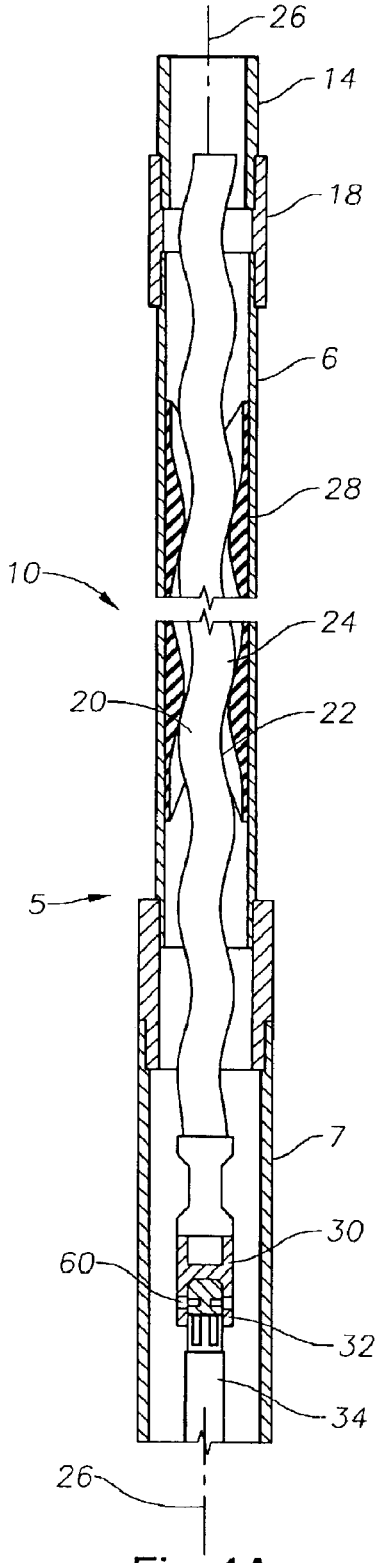
FIG. 1A is a sectional side view of a pump on an upper end of a pump assembly constructed in accordance with this invention.
Figure 1B:
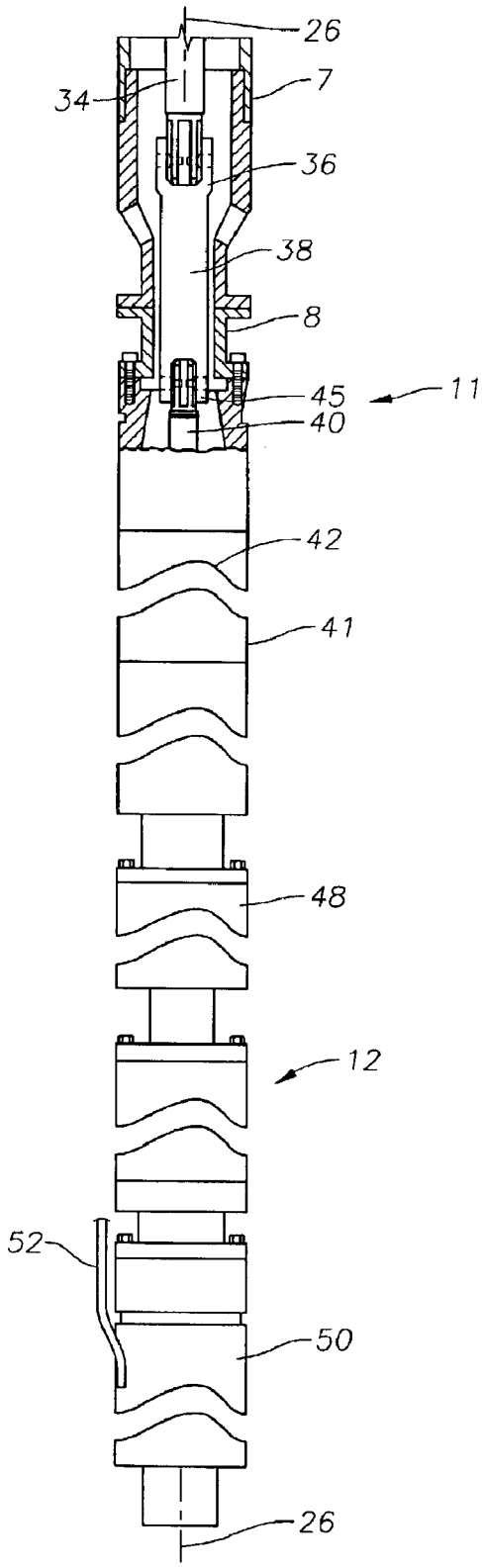
FIG. 1B is a partially sectional side view of a lower end of the pump assembly shown in FIG. 1A.

FIGS. 1A and 1B show a conventional progressing cavity (PC) pump assembly. While the preferred embodiment of the invention described herein relates to PC pump assemblies, the invention is not limited to use in PC pump assemblies only, and may be used in other ESP assemblies as well. In FIGS. 1A and 1B, the pump assembly has a pump assembly housing 5 consisting of a tubular pump housing 6, a flex shaft housing 7, and an intake housing 8. FIG. 1A shows an upper pump assembly section 10. FIG. 1B shows a lower pump assembly section 11 and an electric motor assembly 12. Referring to FIG. 1A, a string of production tubing 14 extends from a wellhead at ground surface (not shown) into a well. Tubular pump housing 6 is located at the lower end of production tubing 14. Pump housing 6 is connected to production tubing 14 with a threaded collar 18.

Within pump housing 6 is a metal rotor 20 with an exterior helical configuration. Rotor 20 has undulations with small diameter portions 22 and large diameter portions 24, which give rotor 20 a curved profile relative to axis 26. Rotor 20 orbitally rotates within an elastomeric stator 28 which is located in pump housing 6. Stator 28 has double or multiple helical cavities located along axis 26 through which rotor 20 orbits.

A rotor coupling 30 attached to the lower end of rotor 20 has a rotor receptacle 32 that receives the upper end of a metal flexible shaft 34. During normal clockwise rotor operation, gravity and the reaction force due to rotor 20 pumping fluid upward will keep rotor receptacle 32 engaged around the upper end of flexible shaft 34. Flexible shaft 34 flexes off of axis 26 at its upper end to allow rotor 20 to orbitally rotate.

Referring now to FIG. 1B, the lower end of flexible shaft 34 is received by a splined receptacle 36 on the upper end of a drive shaft extension 38. Drive shaft 40 extends upward from the top portion of seal section 42 and engages drive shaft extension 38 at drive shaft extension bottom receptacle 45. Drive shaft extension 38 is supported by bearings to keep it radially constrained. Drive shaft extension 38 is located within intake housing 8. The upper end of intake housing 8 is mounted to the lower end of flex shaft housing 7. The lower end of intake housing 8 connects to seal section 42.

The drive shaft 40 is powered by electric motor assembly 12, which is located in a motor assembly housing 41 releasably secured to the lower end of intake housing 8. Motor assembly 12 includes seal section 42 mounted to a gear reduction unit 48. Gear reduction unit 48 is mounted to an electric motor 50. An electrical power cable 52 connects to electric motor 50 and extends up alongside the pump assembly to the ground surface (not shown) for receiving electrical power. Seal section 42 seals well fluid from the interior of electric motor 50 and also equalizes the pressure differential between the lubricant in motor 50 and the pump assembly exterior.

Figure 2A:
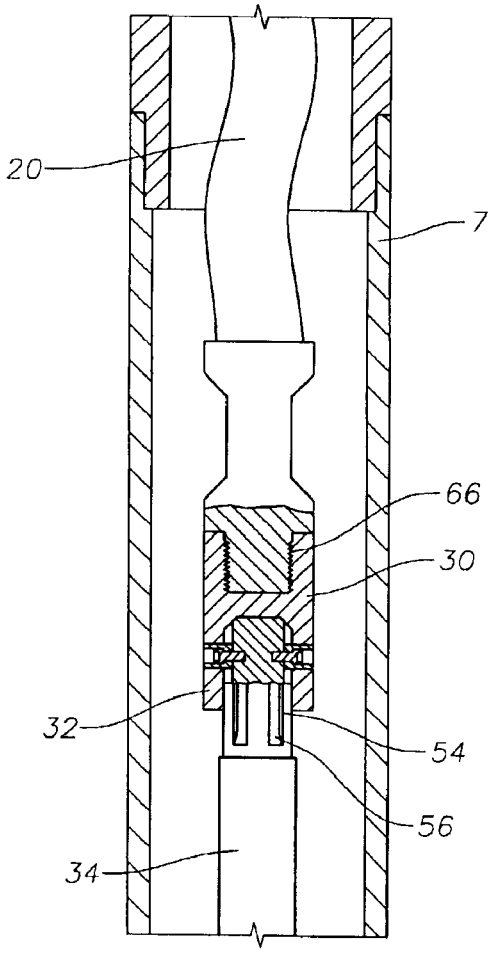
FIG. 2A is an enlarged sectional side view of the rotor, receptacle and flexible shaft shown in FIG. 1A.
Figure 2B:
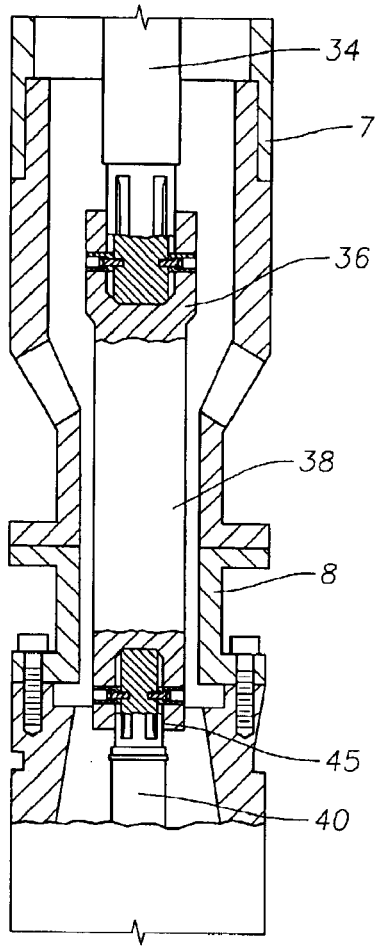
FIG. 2B is an enlarged sectional side view of the coupling assembly and lower end of the flexible shaft shown in FIG. 1B.

FIGS. 2A and 2B show engaged coupling assemblies for shaft elements within the pump assembly. FIG. 2A shows the upper end of flexible shaft 34 engaged with rotor receptacle 32 attached to the lower end of rotor 20. FIG. 2B shows the lower end of flexible shaft 34 engaged with drive shaft extension top receptacle 36 attached to the upper end of drive shaft extension 38.

Referring now to FIG. 2A, rotor receptacle 32 has a bore therewithin with longitudinal internal splines 54 extending downward that are complimentary in size and shape to interfit with the longitudinal external splines 56 of the upper end of flexible shaft 34. Rotor receptacle 32 and flexible shaft 34 have been axially aligned with one another and moved toward engagement. The splined upper end of flexible shaft 34 is inserted into rotor receptacle 32. As a result, the longitudinal external splines 56 at the end of flexible shaft 34 become engaged with the complementary longitudinal internal splines 54 within rotor receptacle 32 to transmit torque.

Referring now to FIG. 2B, drive shaft extension top receptacle 36 has a bore with longitudinal internal splines extending upward that are complimentary in size and shape to interfit with the longitudinal external splines of the lower end of flexible shaft 34. Drive shaft extension top receptacle 36 and flexible shaft 34 have been axially aligned with one another and moved toward engagement. The splined lower end of flexible shaft 34 is inserted into drive shaft extension top receptacle 36. As a result, the longitudinal external splines at the end of flexible shaft 34 become engaged with the complementary longitudinal internal splines within drive shaft extension top receptacle 36 to transmit torque.

Drive shaft extension bottom receptacle 45 has a bore with longitudinal internal splines extending downward that are complimentary in size and shape to interfit with the longitudinal external splines of the upper end of drive shaft 40. Drive shaft extension bottom receptacle 45 and drive shaft 40 have been axially aligned with one another and moved toward engagement. The splined upper end of drive shaft 40 is inserted into drive shaft extension bottom receptacle 45. As a result, the longitudinal external splines at the end of drive shaft 40 become engaged with the complementary longitudinal internal splines within drive shaft extension bottom receptacle 45 to transmit torque.

Figure 4:
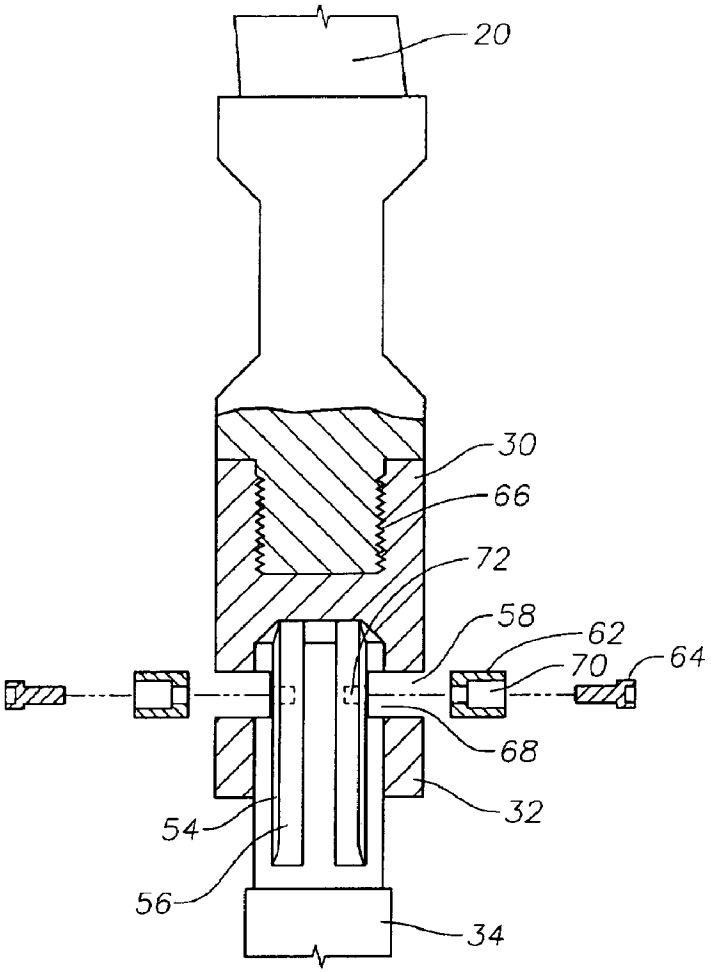
FIG. 4 is a partially exploded sectional side view of the rotor, receptacle, and flexible shaft as shown in FIG. 3.
Figure 3:
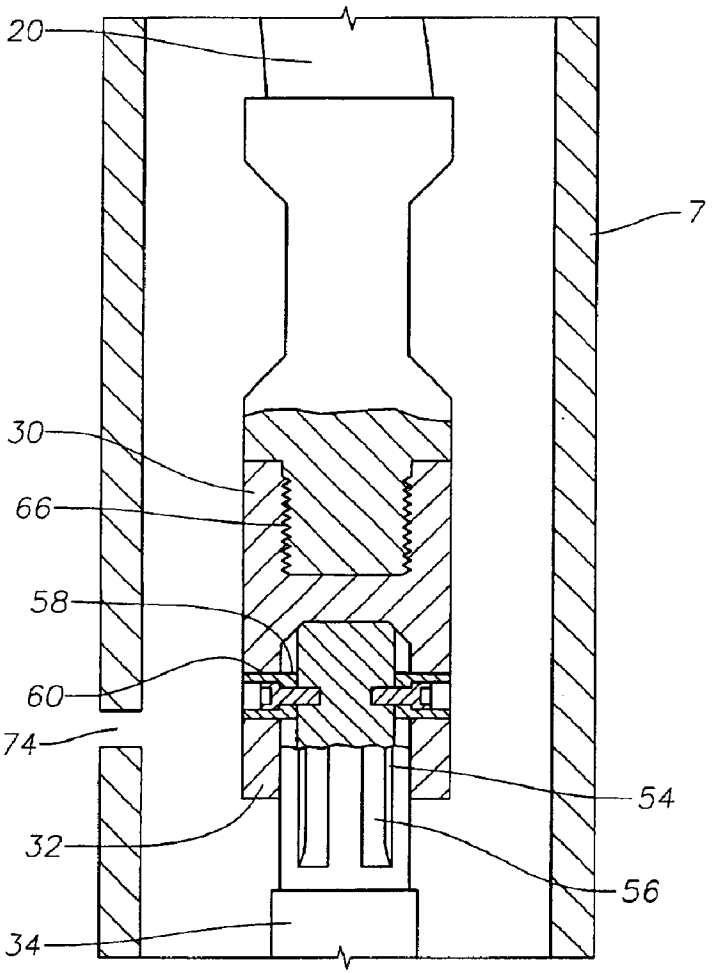
FIG. 3 is an enlarged sectional side view of the rotor, receptacle, and flexible shaft shown in FIG. 2A.

Referring to FIG. 3, rotor 20 is secured by threads 66 to rotor coupling 30. Fastener apertures 58 are positioned such that a fastener 60 can be closely inserted into each fastener aperture 58 and disposed through the walls of rotor receptacle 32 to be secured to the portion of flexible shaft 34 within rotor receptacle 32, thus securely interconnecting flexible shaft 34 to rotor receptacle 32. Referring to FIG. 4, fastener 60 preferably comprises a key 62 and a screw 64. A mating recess 68 is formed on the end of flexible shaft 34 for alignment with fastener aperture 58. Key 62 extends through fastener aperture 58 into recess 68. Key 62 is a cylindrical member with a cavity 70 for receiving a screw 64. Screw 64 secures in a threaded hole 72 in the end of shaft 34. Axial tension between receptacle 32 and flexible shaft 34 transmits through key 62, and not through screw 64.

During initial construction and assembly, some of the adjacent shaft elements within the pump assembly may be interconnected and fastened to one another. For example, rotor 20, flexible shaft 34, and drive shaft extension 38 may be connected with keys 62, then inserted into production tubing 14, pump housing 6, flex shaft housing 7, and intake housing 8 prior to delivery to the well site. Seal section 42 will normally be connected to intake housing 8 or flex shaft housing 7 at the well site. An access port such as hole 74 (FIG. 3) may be located in some section of housing, for example, the housing 7 of flexible shaft 34 or the housing of seal section 42 at the upper end, to allow keys 62 and screws 64 to be installed.

In operation, motor 50 is supplied with power, causing drive shaft 40 to rotate, which in turn rotates rotor 20. Thrust is downward as well fluid is pumped upward through production tubing 14. If motor 50 is shut off, the weight of the fluid in production tubing 14 will fall, causing reverse spinning of rotor 20. Rotor 20 will tend to move upward, causing tension in the couplings to occur. The tension is then transmitted through keys 62, preventing any of the coupling from separating. An upthrust bearing in the seal section shaft (not shown) prevents the shaft from becoming disengaged with the driver components. The same axial tension can occur if motor 50 is powered in reverse rotation.

The invention has significant advantages. By securely interconnecting the adjacent shaft elements in the pump assembly, the upthrust forces of the rotor during counterclockwise motion are transferred to the seal section shaft and the upthrust bearing within the seal section. Thus, the need for a rotor stop is eliminated, which simplifies field use of ESP systems and reduces risk of downhole failures.

While the invention has been shown in only one of its forms, it should be apparent to those skilled in the art that it is not so limited but is susceptible to various changes without departing from the scope of the invention. For example, not all of the couplings need to be splined types; rather, some could be secured other ways, such as by threads.

What is claimed is:

1. A submersible assembly, comprising:

a pump assembly having a pump assembly housing;

an electric motor assembly having a motor assembly housing, the housings being releasably secured to each other;

first and second shafts extending within the housings;

a set of external splines on an end of the first shaft;

a receptacle on an end of the second shaft, the receptacle having a set of internal splines that slide into engagement with the external splines to transmit torque between the shafts, the receptacle having at least two circumferentially spaced apart receptacle holes;

at least two blind holes extending partially into the first shaft perpendicular to an axis of the first shaft, each of the blind holes being in alignment with one of the receptacle holes;

at least two fasteners, each of the fasteners extending transversely through one of the receptacle holes and into one of the blind holes, the fasteners securing the shafts to each other to transmit axial tension from one shaft to the other.

2. The submersible pump assembly of claim 1, wherein each of the blind holes is threaded and each of the fasteners comprises a threaded member.

3. The submersible pump assembly of claim 1, wherein the pump assembly comprises a helical rotor that rotates inside a helical progressing cavity pump stator, and one of the shafts comprises:

a flexible shaft having an upper end that orbits around a central axis of the pump assembly; and a lower end that rotates about a central axis of the pump assembly.

4. A submersible assembly, comprising:

a pump assembly having a pump assembly housing;

an electric motor assembly having a motor assembly housing, the housings being releasably secured to each other;

at least two shafts extending within the housings;

a set of external splines on an end of one of the shafts;

a receptacle on an end of the other shaft, the receptacle having a set of internal splines that slide into engagement with the external splines to transmit torque between the shafts;

at least one fastener that extends transversely through the receptacle, the fastener securing the shafts to each other to transmit axial tension from one shaft to the other; and wherein the fastener comprises a key that extends through a hole in the receptacle and into engagement with a recess in the shaft having the external splines so that axial tension in the shafts transmits through the key.

5. A submersible assembly, comprising:

a pump assembly having a pump assembly housing;

an electric motor assembly having a motor assembly housing, the housings being releasably secured to each other;

at least two shafts extending within the housings;

a set of external splines on an end of one of the shafts;

a receptacle on an end of the other shaft, the receptacle having a set of internal splines that slide into engagement with the external splines to transmit torque between the shafts;

at least one fastener that extends transversely through the receptacle, the fastener securing the shafts to each other to transmit axial tension from one shaft to the other; and wherein the fastener comprises:

a key that extends through a hole in the receptacle and into engagement with a recess in the shaft having the external splines so that axial tension in the shafts transmits through the key; and a screw securing the key within the recess.

6. A submersible pump assembly, comprising:

a progressing cavity pump stator;

a pump assembly housing surrounding the pump stator;

an electric motor assembly having a drive shaft and carried by the pump assembly housing;

a helical rotor located inside the stator;

a flexible shaft coupled between an upper end of the drive shaft and a lower end of the helical rotor;

a first set of splines extending longitudinally upon the lower end of the flexible shaft;

a second set of splines extending longitudinally upon an upper end of the drive shaft, the second set of splines matingly engaging with the first set of splines, one of the sets of splines being located within a receptacle and the other on a exterior for transmitting torque; and a fastener cooperatively connecting the lower end of the flexible shaft and the upper end of the drive shaft, thereby transmitting axial tension.

7. The submersible pump assembly of claim 6, wherein the fastener comprises a threaded member.

8. The submersible pump assembly of claim 6, wherein the receptacle is on the lower end of the flexible shaft.

9. A submersible pump assembly, comprising:

a progressing cavity pump stator;

a pump assembly housing surrounding the pump stator;

an electric motor assembly having a drive shaft and carried by the pump assembly housing;

a helical rotor located inside the stator;

a flexible shaft coupled between an upper end of the drive shaft and a lower end of the helical rotor;

a first set of splines extending longitudinally upon the lower end of the flexible shaft;

a second set of splines extending longitudinally upon an upper end of the drive shaft, the second set of splines matingly engaging with the first set of splines, one of the sets of splines being located within a receptacle and the other on a exterior;

a fastener cooperatively connecting the lower end of the flexible shaft and the upper end of the drive shaft, thereby transmitting axial tension; and wherein the fastener comprises a key that extends through a hole in the receptacle and into engagement with a recess in the shaft having the splines on the exterior so that axial tension in the shafts transmits through the key.

10. A submersible pump assembly, comprising:

a progressing cavity pump stator;

a pump assembly housing surrounding the pump stator;

an electric motor assembly having a drive shaft and carried by the pump assembly housing;

a helical rotor located inside the stator;

a flexible shaft coupled between an upper end of the drive shaft and a lower end of the helical rotor;

a first set of splines extending longitudinally upon the lower end of the flexible shaft;

a second set of splines extending longitudinally upon an upper end of the drive shaft, the second set of splines matingly engaging with the first set of splines, one of the sets of splines being located within a receptacle and the other on a exterior;

a fastener cooperatively connecting the lower end of the flexible shaft and the upper end of the drive shaft, thereby transmitting axial tension; and wherein the fastener comprises:

a key that extends through a hole in the receptacle and into engagement with a recess in the shaft having the splines on the exterior so that axial tension in the shafts transmits through the key; and a screw securing the key to the recess.

11. A submersible pump assembly, comprising:

a progressing cavity pump stator;

a pump assembly housing surrounding the pump stator;

an electric motor assembly having a drive shaft and carried by the pump assembly housing;

a helical rotor located inside the stator;

a flexible shaft coupled between an upper end of the drive shaft and a lower end of the helical rotor;

a first set of splines extending longitudinally upon the lower end of the flexible shaft;

a second set of splines extending longitudinally upon an upper end of the drive shaft, the second set of splines matingly engaging with the first set of splines, one of the sets of splines being located within a receptacle and the other on a exterior;

a fastener cooperatively connecting the lower end of the flexible shaft and the upper end of the drive shaft, thereby transmitting axial tension; and wherein the pump assembly housing has at least one aperture for providing access to the fastener, the fastener comprising:

a key that extends through a hole in the receptacle and into engagement with a recess in the shaft having the splines on the exterior so that axial tension in the shafts transmits through the key;

and a screw securing the key to the recess.

12. A method of installing and operating a submersible pump assembly, the method comprising:

providing an electric motor assembly with a drive shaft having a set of splines on one end;

providing a pump assembly having a progressing cavity pump stator, a helical rotor located inside the stator, and a flexible shaft connected to the rotor which has an upper end that orbits around a central axis of the pump assembly and a lower end that rotates about a central axis of the pump assembly, the flexible shaft having a set of splines on one end, one of the sets of splines being internally located in a receptacle and the other set of splines being external;

bringing the splines toward each other in straight axial movement and causing them to engage;

securing the splines to each other with a fastener;

lowering the motor pump assembly into the well;

causing the rotor to rotate in reverse, thereby causing axial tension between the flexible shaft and the drive shaft; and transmitting the axial tension through the fastener.

* * * * *